United States Patent [19]

Dorow et al.

[11] Patent Number: 4,896,603

[45] Date of Patent: Jan. 30, 1990

[54] APPARATUS FOR CLOSING THE GAP BETWEEN THE ENDS OF A GRAVURE PRINTING PLATE CLAMPED ON A PLATE CYLINDER

[75] Inventors: Joachim Dorow, Hassloch; Gerhard Bleckmann, Lampertheim, both of Fed. Rep. of Germany

[73] Assignee: BASF Aktiengesellschaft, Ludwigshafen, Fed. Rep. of Germany

[21] Appl. No.: 231,276

[22] Filed: Aug. 12, 1988

[30] Foreign Application Priority Data

Aug. 14, 1987 [DE] Fed. Rep. of Germany ..... 3727115

[51] Int. Cl.[4] ..... B41F 27/12

[52] U.S. Cl. ..... 101/375; 101/494

[58] Field of Search ..... 101/375, 378, 415.1, 101/494

[56] References Cited

U.S. PATENT DOCUMENTS

| | | | |
|---|---|---|---|
| 4,515,375 | 5/1985 | Bleckmann et al. | 277/1 |
| 4,561,355 | 12/1985 | Cuir et al. | 101/378 |
| 4,680,067 | 7/1987 | Moore | 101/378 X |

FOREIGN PATENT DOCUMENTS

| | | | |
|---|---|---|---|
| 174568 | 3/1986 | European Pat. Off. | 101/375 |
| 3401501 | of 0000 | Fed. Rep. of Germany . | |

*Primary Examiner*—Clifford D. Crowder

*Attorney, Agent, or Firm*—Keil & Weinkauf

[57] ABSTRACT

The gap between the ends of a gravure printing plate (3) clamped on a plate cylinder (1) is closed by an apparatus having a gap (5) -covering plate (6) and means for filling the gap cavity with plastic and curable material, consisting of two shaped pieces (7), which are mounted on the shaft ends of the plate cylinder, and a section (8) which is firmly connected to the shaped pieces and in which two displaceable pressure bars (9) are incorporated, wherein a plurality of pressure screws (10) distributed over the length of the pressure bars are arranged above each of the pressure bars.

1 Claim, 2 Drawing Sheets

Figure 1:
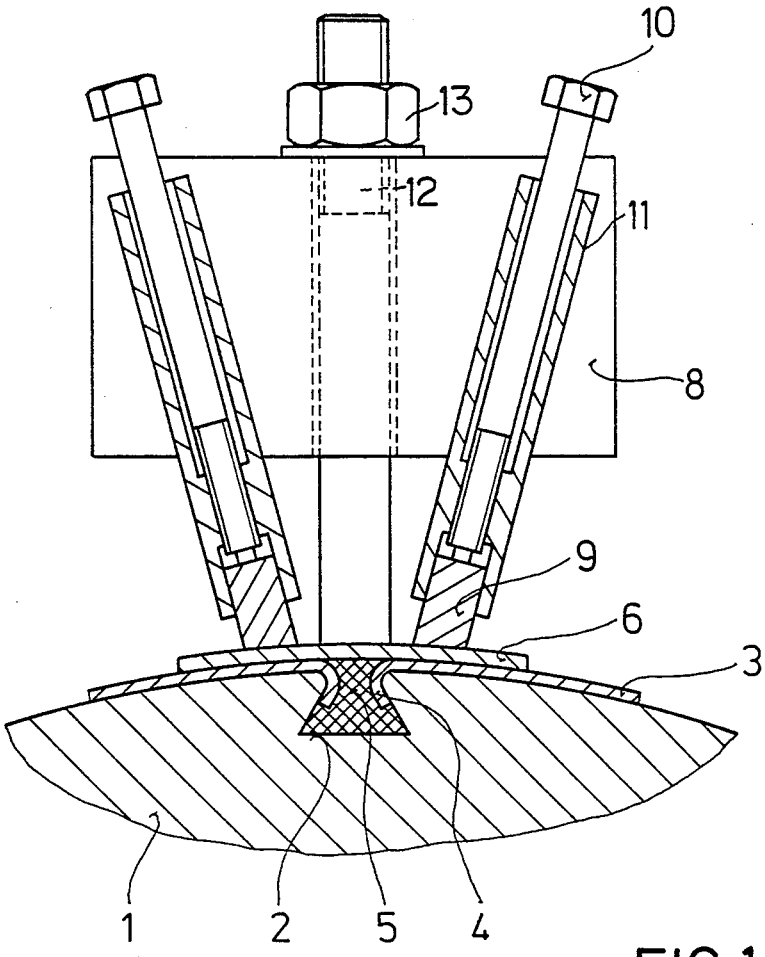

APPARATUS FOR CLOSING THE GAP BETWEEN THE ENDS OF A GRAVURE PRINTING PLATE CLAMPED ON A PLATE CYLINDER

The present invention relates to an apparatus for closing the gap between the ends of a gravure printing plate clamped on a plate cylinder having a shaft and having formed below the gap a gap cavity into which plastic and curable material is introduced.

It is known that gravure printing plates consisting of a dimensionally stable and flexible base and a top layer applied on this base can be clamped on a plate cylinder of a sheet-fed or rotary printing press. For this purpose, the plate cylinder is provided with a groove which runs parallel or obliquely with respect to the plate cylinder axis and into which the bent-over ends of the gravure printing plate are hooked at an acute angle and in which they are held firmly. The resulting gap between the two ends of the gravure printing plate is closed with the abovementioned plastic and curable material which is introduced into the gap after the latter has been covered with a sheet-like piece, for example a gap-covering plate, by means of a thrust piece (cf. DE-A 33 08 807).

In the further development of the above apparatus shown in DE-A 34 01 501, the thrust piece was replaced by two support members respectively mounted on the shaft ends of the cylinder, a mounting structure interconnecting the support members, and a pair of pressure bars, one on each side of the gap, which extend along the length of the cylinder. In the apparatus disclosed in the aforementioned DE-A 34 01 501 the assembly of each of the two support members is, overall, of curved (U-shaped) configuration and thus these two assemblies had to be extremely rigid to prevent partial lifting of the gap-closing plate during injection of the plastic material. The result was that plastic material was forced out under the plate.

All the abovementioned apparatus have the disadvantage that they are very heavy and are furthermore difficult to handle. Moreover, these apparatus are not sufficiently flexible when changing over to different cylinder diameters. Finally, bending of the abovementioned support arms during injection of the plastic material could not be prevented.

It is an object of the present invention to provide an apparatus for closing the gap between the ends of a gravure printing plate clamped on a plate cylinder, which apparatus is substantially lighter in weight so that smaller pressure units can be used and it can be handled by one person. Furthermore, it should be possible to close the gap on the plate cylinder transport trolley or in the printing press itself, and bending of the support arms should be excluded.

We have found that this object is achieved, according to the invention, if a plurality of pressure screws distributed over the length of the pressure bars are arranged above each of the pressure bars.

Figure 2:
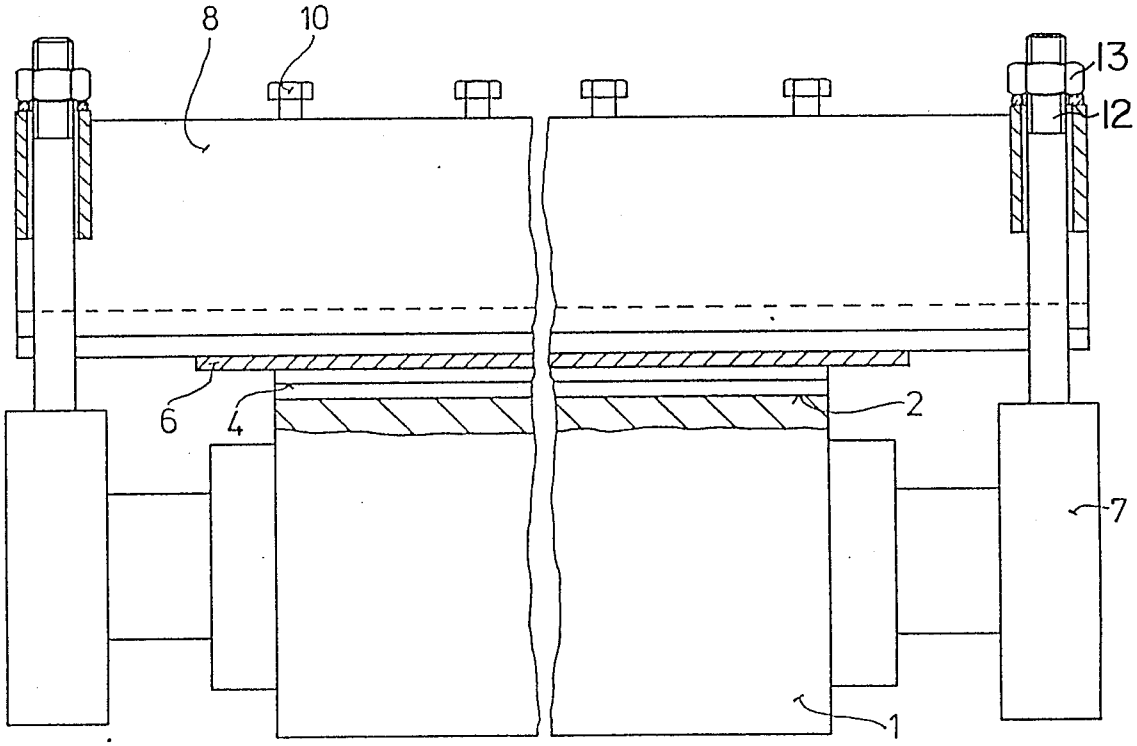

For a better understanding of the invention, an embodiment is described below with reference to the drawing:

FIG. 1 shows a cross-section through the plate cylinder with a clamped gravure printing plate and the novel apparatus for closing the gap, and FIG. 2 shows a longitudinal section through the plate cylinder in FIG. 1.

The plate cylinder 1 of a sheet-fed or rotary gravure printing press is, as shown in FIGS. 1 and 2, provided with a groove 2 which runs along the plate cylinder axis and widens from the cylinder surface toward the cylinder center and into which the two bent-over ends 4 of the gravure printing plate 3 clamped on the plate cylinder are hooked at an acute angle. To close the gap 5 between the two ends, a plate 6 which extends beyond the two end sections of the gravure printing plate and which is resilient and flexible or is shaped to the contour of the cylinder surface is placed on top. The plate is pressed by means of the novel apparatus, whose construction is described below.

A solid mounting structure 8, at its two ends, is firmly connected to two support arms 7, respectively, which in turn are mounted on the shaft ends of the plate cylinder. As will be noted from the drawings, the mounting structure 8 is secured to the upper, threaded ends 12 of the support arms 7 by means of nuts 13, the opposite ends of support arms 7 simply being slid onto the cylinder shaft. The mounting structure 8 includes guide members 11 holding a pair of pressure bars 9, one on each side of the gap, and each extending along the length of the cylinder, for displacement in the direction of the cylinder. In addition, a plurality of pressure screws are distributed over the entire length of the pressure bars and are mounted in guide members 11 in alignment with the pressure bars for engagement of the upper end of these bars. Upon tightening of these screws the pressure bars 9 urge the gap-covering plate 6 with great force against the printing plate 3 over the entire length of cylinder 1 on both sides of the gap. As a result, there is contact between the plate and the gravure printing plate along the entire length of the cylinder, along both sides of the gap. The outflow of the plastic material, during its introduction, between the gap-covering plate and the printing plate is thus effectively counteracted.

We claim:

1. Apparatus for closing the gap between the ends of a gravure printing plate clamped on a plate cylinder having a shaft and having formed below said gap a gap cavity into which plastic and curable material is introduced, said apparatus comprising:

a gap-covering plate, two support members respectively mounted on the shaft ends of the plate cylinder, a mounting structure interconnecting said support members, and a pair of pressure bars, one on each side of the gap, which extend along the length of the cylinder;

wherein said mounting structure includes guide members which hold said pressure bars for displacement in the direction of the cylinder, and wherein a plurality of pressure screws distributed over the entire length of the pressure bars are mounted in said guide members in alignment with said pressure bars for engagement of the upper end of said bars, so that, upon the tightening of said screws said pressure bars urge said gap-covering plate against said printing plate over the entire length of the cylinder on both sides of said gap, thereby effectively counteracting the outflow of said plastic material, during its introduction, between said gap covering plate and said printing plate.

* * * * *